United States Patent [19]

Bennett

[11] 4,437,368

[45] Mar. 20, 1984

[54] APPARATUS AND METHOD OF REDUCING TREES TO FIREWOOD

[76] Inventor: Nicholas L. Bennett, Rte. #3, Abilene, Kans. 67410

[21] Appl. No.: 381,556

[22] Filed: May 24, 1982

[51] Int. Cl.[3] ..... B27B 1/00

[52] U.S. Cl. ..... 83/13; 83/78; 83/795; 83/801; 105/160

[58] Field of Search ..... 83/795, 797, 801, 78, 83/13; 105/160

[56] References Cited

U.S. PATENT DOCUMENTS 2,990,192 6/1961 Leach ..... 105/160

3,260,288 7/1966 Currie ..... 83/801

3,623,517 11/1971 Neumann ..... 83/78

3,771,395 11/1973 Heimerl ..... 83/795

*Primary Examiner*—Donald R. Schran

*Attorney, Agent, or Firm*—John H. Widdowson

[57] ABSTRACT

An apparatus and method for reducing trees to firewood. The apparatus has an angle iron frame supported by at least two wheels and a plurality of upright yoke supports spacedly positioned along the angle iron frame for holding tree logs to be cut between any pair of contiguous yoke supports by a chain saw. The method includes placing the logs on the yoke supports for cutting.

3 Claims, 4 Drawing Figures

APPARATUS AND METHOD OF REDUCING TREES TO FIREWOOD

BACKGROUND OF THE INVENTION

1. Field of the Invention

This invention provides an apparatus and method for reducing trees to firewood. More specifically, this invention includes an apparatus and method means for placing logs on portable upright yoke supports in order to cut the logs with a chain saw between any two contiguous upright yoke supports.

2. Description of the Prior Art

U.S. Pat. No. 180,454 by Bowen discloses a miter box provided with a plurality of grooves whereby the wood may be cut as desired. U.S. Pat. No. 2,398,192 by Scheminger, Jr. discloses a slicing board wherein an object to be sliced may be placed between the two uprights and the same cut into a plurality of pieces as desired, U.S. Pat. No. 1,205,806 by Stafford discloses a wood sawing machine for cutting logs into desired lengths with a plurality of saws. U.S. Pat. No. 3,053,290 by Fitzgerald discloses a sawbuck for a chain saw wherein a pair of spaced members support the wood to be cut and the chain saw moved to cut the wood as desired. None of the foregoing prior art teaches or suggests the particular apparatus and method of this invention.

SUMMARY OF THE INVENTION

This invention accomplishes its desired objects by providing an apparatus for reducing trees to firewood comprising an angle iron frame means supported by at least two wheels; and a plurality of upright yoke support means spacedly positioned along the angle iron frame means for holding tree logs to be cut between any pair of contiguous yoke support means by a chain saw means. The process for reducing trees to firewood includes placing the tree log upon the yoke support means to elevate the tree log above the ground; and cutting the tree log between a predetermined pair of contiguous yoke support means, depending on the length of firewood desired.

It is an object of the invention to provide a novel apparatus and method for reducing trees to firewood.

This, together with the various ancillary objects and features will become apparent as the following description proceeds, are attained by this invention, preferred embodiments being shown in the accompanying drawings, by way of example only, wherein:

DETAILED DESCRIPTION OF THE INVENTION

Figure 1:
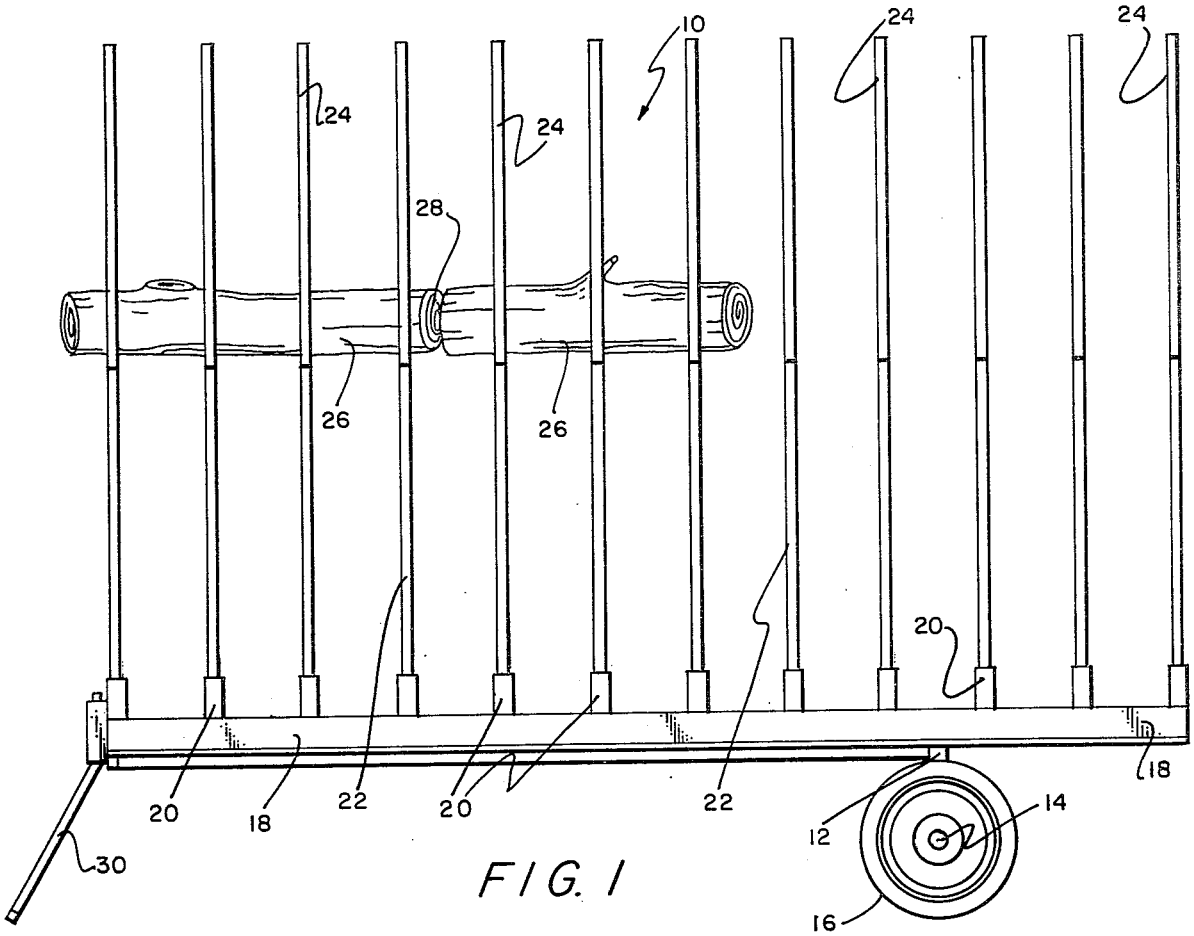
FIG. 1 is a side elevational view of the invention.
Figure 2:
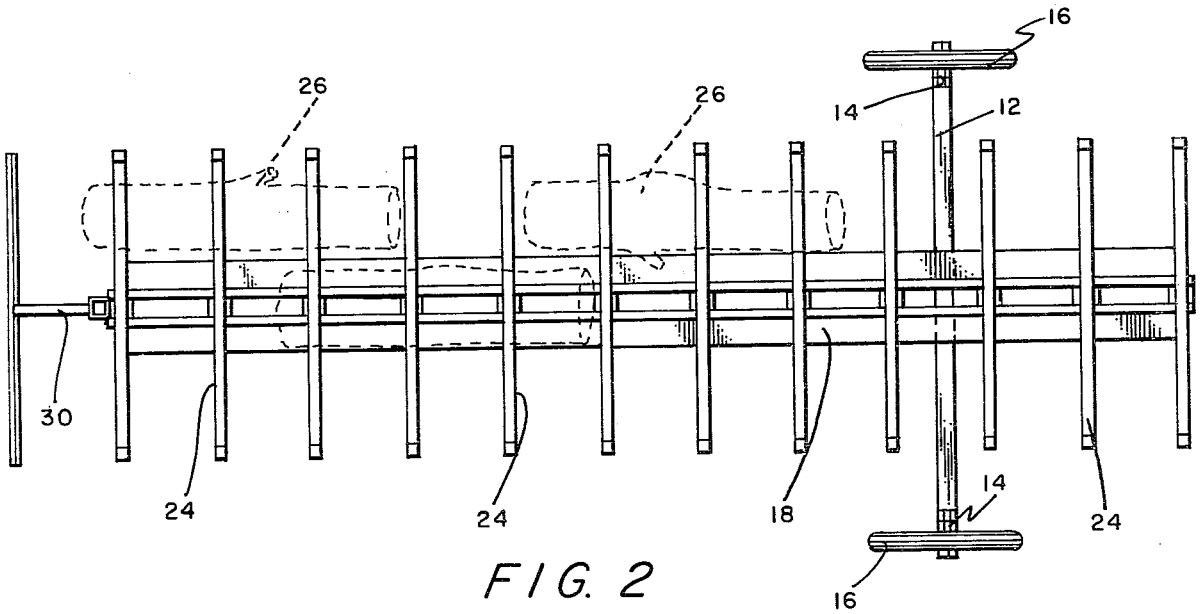
FIG. 2 is a top plan view of the invention.
Figure 3:
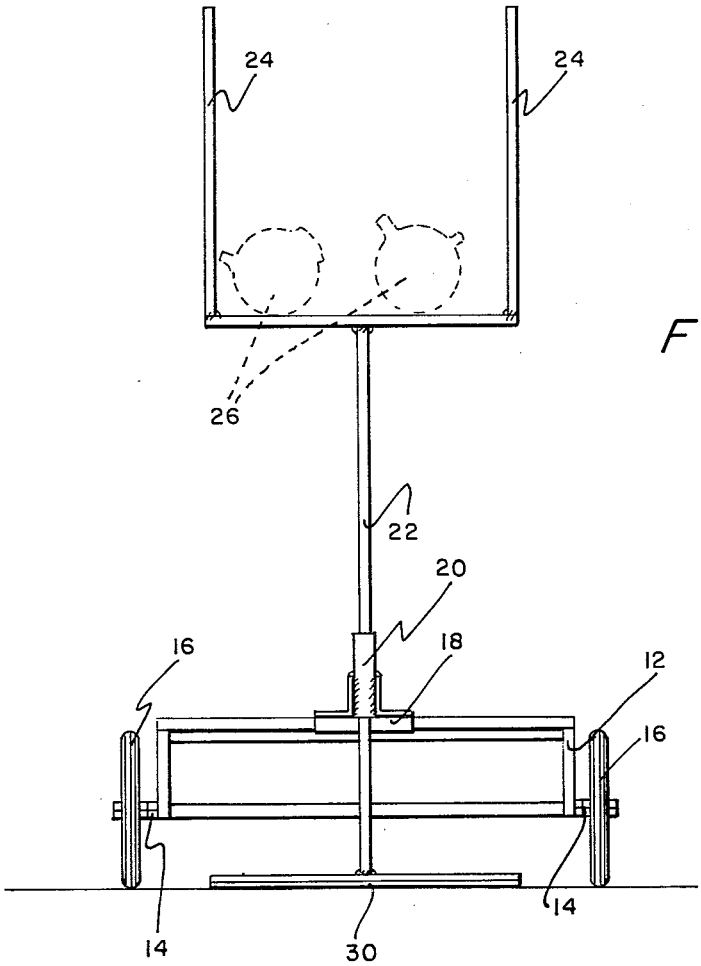
FIG. 3 is an end elevational view of the invention.
Figure 4:
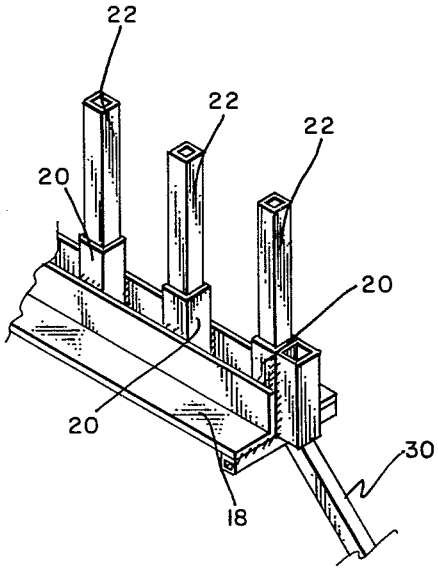
FIG. 4 is a partial perspective view of the stanchion members slidably and removably disposed within one of the holders, along with the handle-brace member slidably and removably disposed within and underneath an end holder.

Referring in detail now to the drawings, there is seen the apparatus for reducing trees to firewood, generally illustrated as 10, having a tubular generally rectangularly shaped support frame 12 and an axle 14 slidably rotatably positioned through the bottom of the support frame 12. A pair of wheels 16—16 rotatably attach to the axle 14. Angle iron frame 18 is supported by and bound to the support frame 12 over the axle 14 of the wheels 16—16. A plurality of tubular support holders 20 is integrally bound to the angle iron frame 18 and spacedly positioned along the same. A plurality of removable tubular stanchions 22 are slidably and removably disposed within the plurality of tubular holders 20. A generally U-shaped yoke top 24 is bound to each of the plurality of stanchions 22 at the top thereof for holding and supporting tree log 26 such that a chain saw means (not shown in the drawings) can cut the log 26 between any two contiguous yoke U-shaped tops 24 (e.g. at 28 in FIG. 1). A handle-brace 30 removably attaches to an end of the angle iron frame 18 (see FIG. 4) for pulling the apparatus 10 or bracing the same off the ground in a generally parallel position (see FIGS. 1 and 3) when the apparatus 10 is not being moved.

With continuing reference to the drawings for the operation of reducing trees to firewood with a chain saw, tree log 26 is placed upon a plurality of the upright yoke U-shaped support tops 24 which are supported by stanchions 22. This elevates the tree log 26 sufficiently above the ground in order to facilitate the cutting of the log 26 while being held by the yoke U-shaped support tops 24. Subsequently, a chain saw, or the like, is placed between a predetermined pair of yoke U-shaped support tops 24, depending on the length of the firewood desired, in order to cut the log 26. For example, in FIG. 1 the chain saw would be placed between the fourth and fifth yoke U-shaped support tops 24 from the handle-brace 30 end of the apparatus 10 in order to cut the log 26 at 28. Subsequently, tree log 26 may be cut again between another pair of yoke U-shaped support tops 24 further away from the handle-brace 30 end of the apparatus 10, especially if the log 26 traverses the entire length of the apparatus 10.

After the log 26 has been cut a sufficient number of times into desired lengths, the cut log 26 may be removed from the yoke U-shaped support tops 24. I have discovered that an ideal way for manual removal is to start at one of the ends of the apparatus 10. For illustrative purposes let's commence the removal of the cut log 26 from the handle-brace 30 end. The person removing the cut log 26 positions himself or herself at the handle-brace 30 end and removes the cut log 26 supported by the first four yoke U-shaped support tops 24. Subsequently, the first four yoke U-shaped tops 24 are removed from the holders 20 of the apparatus 10 in order to have easier access to the additionally cut tree log 26 remaining supported by the remaining yoke U-shaped support tops 24. The removal process is repeated until all of the cut logs 26 are removed from the apparatus 10.

Having thus described the invention, what I claim as new and desire to secure by Letters Patent is:

1. An apparatus for reducing trees to firewood comprising:

an angle iron frame means supported by at least two wheels; and a plurality of upright yoke support means spacedly positioned along the angle iron frame means for holding tree logs to be cut between any pair of contiguous yoke support means by a chain saw means; a plurality of yoke holder means integrally bound to the iron frame means for detachably securing said plurality of upright yoke support means; each of said yoke support means comprises a stanchion means bound to an essentially U-shaped top wherein said logs rest supportedly, each of said stanchion means of each yoke support means being slidably disposed within each of said holder means; a rectangular shaped support frame means for supporting said angle iron frame means over said wheels; an axle slidably rotatably positioned within the bottom of said rectangular shaped support frame means; said support frame means, said yoke holder means, and said yoke means comprise a tubular structure.

2. An apparatus for reducing trees to firewood by cutting with a chain saw means comprising a tubular rectangular shaped support frame; an axle slidably rotatably positioned through the bottom of the tubular support frame; a pair of wheels rotatably attached to the axle; an angle iron frame supported by the support frame over the wheels; a plurality of tubular support holders integrally bound to the angle iron frame and spacedly positioned along the same; a plurality of stanchions slidably and removably disposed within the plurality of tubular holders; a generally U-shaped top bound to each and supported by each top of said stanchions for holding and supporting the tree logs while the chain saw means cuts the same at least one time between any two contiguous U-shaped tops; and a handle-brace attached to the end of the angle iron frame for pulling the apparatus or bracing the same off the ground in a generally parallel position when the apparatus is not being moved.

3. A process for reducing trees to firewood comprising the steps of:

(a) placing at least one tree log upon a plurality of detachable upright yoke support means having a U-shaped top and spacedly positioned along an angle iron frame means to elevate the tree log above the ground;

(b) cutting the tree log between a predetermined pair of contiguous yoke support means, depending on the length of firewood desired, by a chain saw means;

(c) cutting additionally the tree log between at least one more predetermined pair of contiguous yoke support means by the chain saw means;

(d) removing the cut tree log of step (b) from a portion of the plurality of yoke support means;

(e) detaching the upright yoke support means which were holding the cut tree log of step (d) in order to have easier access to the additionally cut tree log of step (c); and (f) removing the additionally cut tree log of step (c) from a remaining portion of the plurality of yoke support means.

* * * * *